US005365677A

United States Patent [19]

Dalhgren

[11] Patent Number: 5,365,677

[45] Date of Patent: Nov. 22, 1994

[54] FOOTWEAR FOR FACILITATING THE REMOVAL AND DISSIPATION OF PERSPIRATION FROM THE FOOT OF A WEARER

[76] Inventor: Raymond E. Dalhgren, P.O. Box 614, Arcadia, Calif. 91066

[21] Appl. No.: 906,702

[22] Filed: Jun. 30, 1992

[51] Int. Cl.[5] ..... A43B 7/06; A43B 23/26; A43B 23/00

[52] U.S. Cl. ..... 36/3 A; 36/54; 36/45

[58] Field of Search ..... 36/44, 3 R, 3 A, 45, 36/54

[56] References Cited

U.S. PATENT DOCUMENTS

| | | | |
|---|---|---|---|
| Re. 19,494 | 3/1935 | Glidden et al. | 36/3 R X |
| 757,424 | 4/1904 | Vohl | 36/3 A |
| 1,215,198 | 2/1917 | Rothstein | 36/54 |
| 2,210,430 | 8/1940 | Post | 36/54 |
| 2,242,353 | 5/1941 | Gillis | 36/54 |
| 2,651,854 | 9/1953 | Taber et al. | 36/3 A |
| 2,775,049 | 12/1956 | Apteker et al. | 36/3 R |
| 2,869,253 | 1/1959 | Sachs | 36/3 |
| 2,897,610 | 8/1959 | Campagna | 36/54 X |
| 3,130,505 | 4/1964 | Markevitch | 36/45 |
| 3,284,931 | 11/1966 | Dassler | 36/54 |
| 3,642,563 | 2/1972 | Davis et al. | 36/45 X |
| 3,668,793 | 6/1972 | Stohr et al. | 36/71 |
| 4,232,458 | 11/1980 | Bartels | 36/45 |
| 4,377,913 | 3/1983 | Stone | 36/99 |
| 4,430,811 | 2/1984 | Okada | 36/45 |
| 4,438,574 | 3/1984 | Johnson | 36/45 |
| 4,458,429 | 7/1984 | Schmid | 36/3 A |
| 4,461,099 | 7/1984 | Bailly | 36/44 |
| 4,464,850 | 8/1984 | Ebert et al. | 36/44 |
| 4,785,558 | 11/1988 | Shiomura | 36/114 |
| 4,898,007 | 2/1990 | Dahlgren | 2/239 X |
| 4,910,837 | 3/1990 | Turner et al. | 37/3 R X |

*Primary Examiner*—Paul T. Sewell
*Assistant Examiner*—Beth Cicconi
*Attorney, Agent, or Firm*—Marshall A. Lerner

[57] ABSTRACT

Footwear is provided for added comfort to the wearer by facilitating the removal and dissipation of perspiration from the foot of the wearer. The footwear has a knitted sock and a shoe in combination. The knitted sock has a toe portion formed of hydrophilic knit fabric and an instep portion adjacent the toe portion formed of hydrophobic knit fabric. Perspiration from the toe portion of the foot of the wearer is absorbed by the knit hydrophilic toe portion of the knitted sock and wicked therefrom by the hydrophobic knit instep portion of the knitted sock. The shoe has a tongue portion overlying and contacting the hydrophobic knit instamp portion of the knitted sock. The tongue portion of the shoe has overlying inner and outer fabric layers formed of hydrophilic fabric and an intermediate fabric layer positioned between the overlying inner and outer hydrophilic fabric layers. The intermediate fabric layer has a medial portion formed of a hydrophobic fabric layer and opposite side portions formed of hydrophilic fabric layers. The inner hydrophilic fabric layer overlies and, is in contacting engagement with the hydrophobic knit instep portion of the knitted sock. The perspiration from the hydrophobic knit instep portion of the knitted sock is absorbed by the overlying and contacting inner hydrophilic fabric layer and the hydrophilic fabric opposite side portions of the intermediate fabric layer and wicked therefrom by the contacting hydrophobic fabric layer medial portion of the intermediate fabric layer. The perspiration is then transferred from the hydrophobic fabric layer medial portion to the overlying outer hydrophilic fabric layer of the tongue portion of the shoe for evaporation therefrom to atmosphere.

46 Claims, 5 Drawing Sheets

FOOTWEAR FOR FACILITATING THE REMOVAL AND DISSIPATION OF PERSPIRATION FROM THE FOOT OF A WEARER

FIELD OF THE INVENTION

This invention relates generally to footwear and more particularly to footwear for providing added comfort to the wearer by facilitating the removal and dissipation of perspiration from the foot of the wearer.

BACKGROUND OF THE INVENTION

Generally, moisture or perspiration forms in the foot area of a person especially when a sock or shoe is worn on the foot. The perspiration may become excessive when the person exercises, such as when hiking or running. This excess perspiration accumulating around the foot and in the footwear is often uncomfortable and irritating.

Previously, shoes have been designed and constructed to keep moisture out of the shoe with little or no consideration for perspiration formed within the shoe. An example of such shoes may be seen in U.S. Pat. No. 2,897,610 to Campagna entitled *Heat Insulated, Gusset-Type, Waterproof Footwear*. Recently, shoes have been designed which attempt to keep the innermost layer of the shoe nearest the foot dry by providing a high moisture permeable and low moisture holding material for this layer of the entire shoe and a layer overlying the innermost layer for further insulating the foot from moisture. An example of such a shoe may be seen in U.S. Pat. No. 4,430,811 to Okada entitled Footwear. Also, other shoes have been designed which recognize the need to ventilate the shoe by providing perforations in the tongue area of the shoe. An example of this type of shoe is disclosed in U.S. Pat. No. 4,458,429 to Schmid entitled *Tongue for a Shoe, Particularly a Sport Shoe, and a Shoe Including a Tongue.*

Unfortunately, these prior shoes failed to recognize that about two thirds of the perspiration from the wearer accumulates in the ball and toe areas of the foot. Simply insulating the foot from outside moisture, absorbing moisture into the footwear, and providing ventilation to the shoe through a series of perforations did not solve the problem of accumulation of excess perspiration around the ball and toe areas of the foot.

The inventor of the present invention, on the other hand, recognized that the prior footwear failed to adequately remove perspiration from the ball and toe areas and, therefore, developed and patented a unique sock, disclosed in U.S. Pat. No. 4,898,007 entitled *Moisture Management Sock*, to solve this problem. While this unique moisture management sock improved the dissipation of moisture from conventional shoes, further improvement is still highly desirable.

SUMMARY OF THE INVENTION

It is therefore an object of the present invention to provide footwear for the removal and dissipation of perspiration from the foot of the wearer.

This and other objects are provided in accordance with the present invention, by footwear for facilitating the removal and dissipation of perspiration from the foot of a wearer. Particularly, the footwear has a knitted sock and a shoe in combination.

The knitted sock has a toe portion made of hydrophilic knit fabric and an instep portion made of hydrophobic knit fabric adjacent the hydrophilic knit toe portion. Perspiration around the toe portion of the foot of the wearer is absorbed by the hydrophilic knit toe portion of the knitted sock and wicked therefrom by the adjacent hydrophobic knit instep portion of the knitted sock.

The shoe has a tongue portion overlying and contacting the hydrophobic knit instep portion of the knitted sock. The tongue portion of the shoe has overlying inner and outer fabric layers comprising a hydrophilic inner layer and a hydrophilic outer layer. An intermediate fabric layer comprising a medial portion formed of a hydrophobic fabric layer and opposite side portions formed of hydrophilic fabric layers is positioned between the overlying inner and outer hydrophilic fabric layers and is in contacting engagement therewith. The inner hydrophilic fabric layer overlies and contacts the hydrophobic knit instep portion of the knitted sock so that perspiration from the hydrophobic knit instep portion is absorbed by the overlying inner hydrophilic fabric layer and the overlying and contacting hydrophilic fabric opposite side portions of the intermediate fabric layer of the tongue portion of the shoe and wicked therefrom by the contacting hydrophobic fabric layer medial portion of the intermediate fabric layer of the tongue portion of the shoe. The perspiration is then transferred from the contacting intermediate hydrophobic fabric layer medial portion to the overlying outer hydrophilic fabric layer for evaporation therefrom to atmosphere.

Additionally, wick stitching formed of textile thread may extend from the hydrophobic fabric layer medial portion into the hydrophilic fabric opposite side portions of the intermediate fabric layer of the tongue portion of the shoe and further extend from the intermediate fabric layer into the inner hydrophilic fabric layer to enhance the flow of perspiration therethrough.

DESCRIPTION OF THE PREFERRED EMBODIMENTS

The present invention now will be described more fully hereinafter with reference to the accompanying drawings in which preferred embodiments of the invention are shown. This invention may, however, be embodied in many different forms and should not be construed as limited to the embodiments set forth herein; rather, these embodiments are provided so that this disclosure will be thorough and complete and will fully convey the scope of the invention to those skilled in the art. Like numbers refer to like elements throughout.

Figure 1:
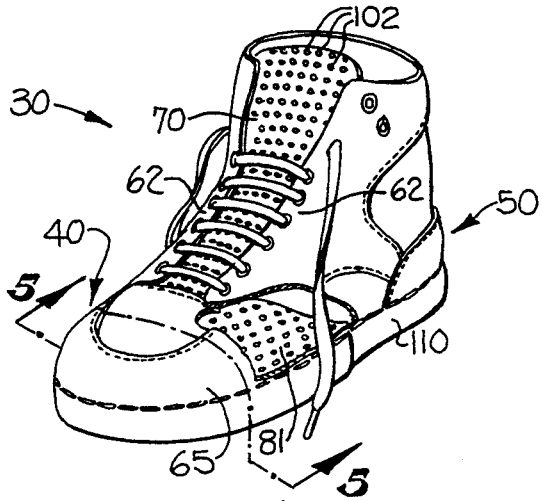
FIG. 1 is a perspective view of an embodiment according to the present invention in the form of an athletic shoe with parts broken away for clarity.
Figure 2:
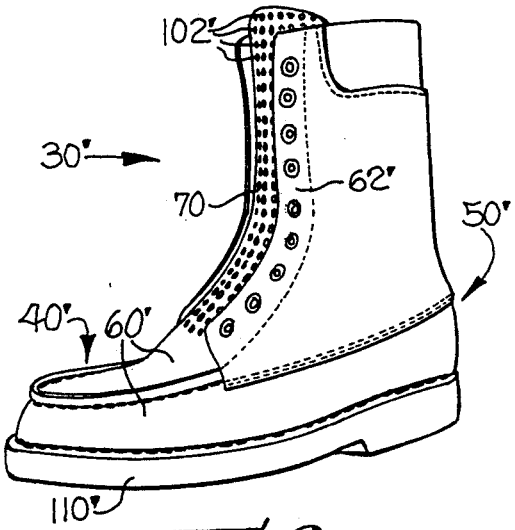
FIG. 2 is also a perspective view of another embodiment according to the present invention in the form of a boot.
Figure 3:
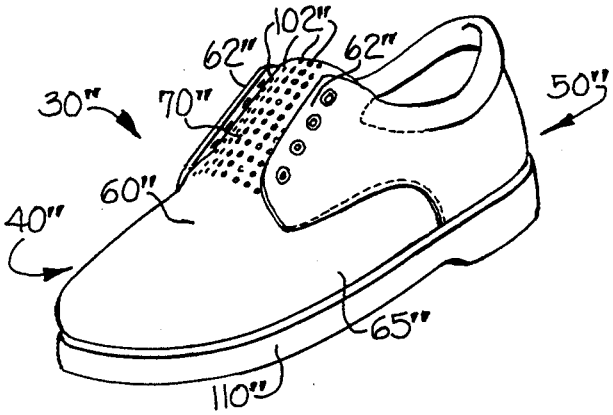
FIG. 3 is a perspective view of yet another embodiment according to the present invention in the form of a casual dress shoe.

Referring to FIGS. 1–3, shown are perspective views of various embodiments of shoes according to the present invention. The embodiment of FIG. 1 is in the form of an athletic shoe 30 with a perforated tongue portion 70. The athletic shoe 30 has a toe portion 40, a heel portion 50, an instep portion 60, and a sole portion 110. The toe portion 40 of the athletic shoe 30 is connected to the instep portion 60. The instep portion 60 has a tongue portion 70 and a lower arch portion 65. The tongue portion 70 of the instep portion 60 is connected to the toe portion 40 and a facing section 62 of the instep portion 60. A series of perforations 102 are shown along the outer surface of the tongue portion 70. The lower arch portion 65 of the instep portion 60, in turn, is connected to the toe portion 40, the heel portion 50, and the sole portion 110.

The tongue portion 70 of the athletic shoe 30 shown in FIG. 1 may also be adapted for other embodiments of shoes such as the boot shown in FIG. 2 and the casual dress shoe shown in FIG. 3. References to additional figures herein will use the athletic shoe 30 of FIG. 1, but the description would similarly apply to other embodiments such as those shown in FIGS. 2 and 3. Similar elements in FIGS. 2 and 3 are labelled with prime and double prime notation corresponding to FIG. 1 and are not described further herein.

Figure 4:
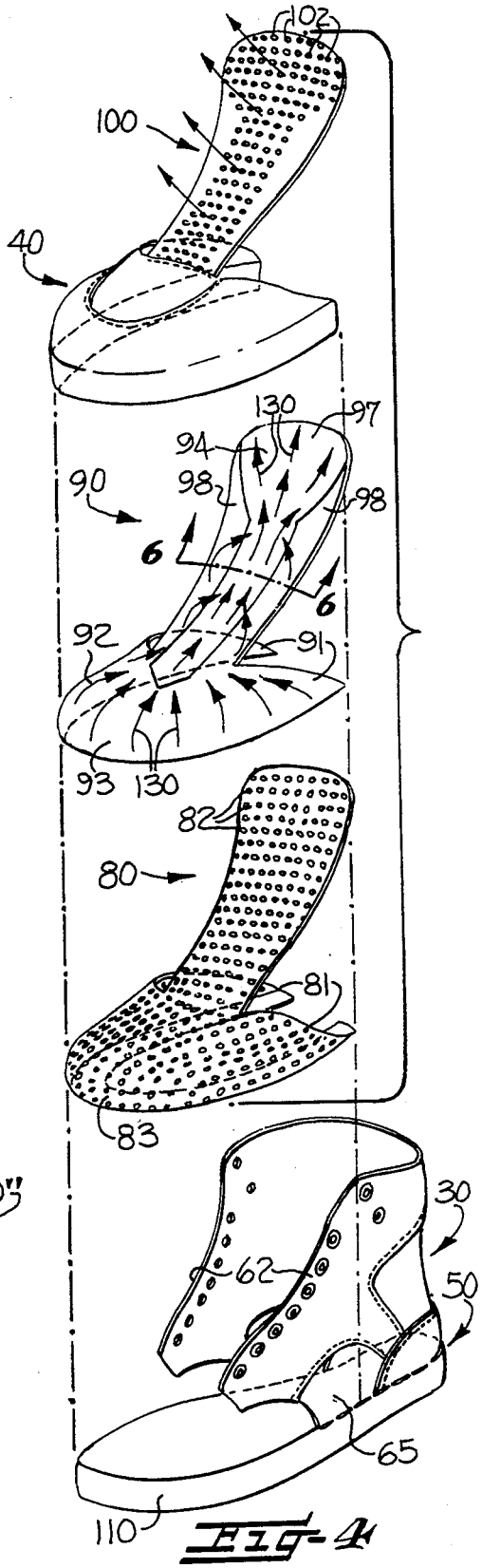
FIG. 4 is an exploded view of the athletic shoe shown in FIG. 1.

Now for further describing the tongue portion of athletic shoe 30, reference will be made to FIGS. 4–7. In FIG. 4, shown is an exploded view of the athletic shoe 30 shown in FIG. 1 illustrating the layered tongue portion 70 and toe portion 40 of the shoe 30. An inner fabric layer 80 of the tongue portion 70 is constructed of hydrophilic fabric having perforations 82. The fabric in this inner layer so is not restricted to any one fiber type and may be leather or nylon. The perforations 82 enhance the flow of perspiration 130 through the inside of the shoe 30. The flow or movement of the perspiration 130 is enhanced by heat and movement around the wearer's foot. This flow of perspiration 130 through the tongue portion 70 of the shoe 30 may further be seen in the fragmentary perspective views of FIGS. 5–7.

Figure 5:
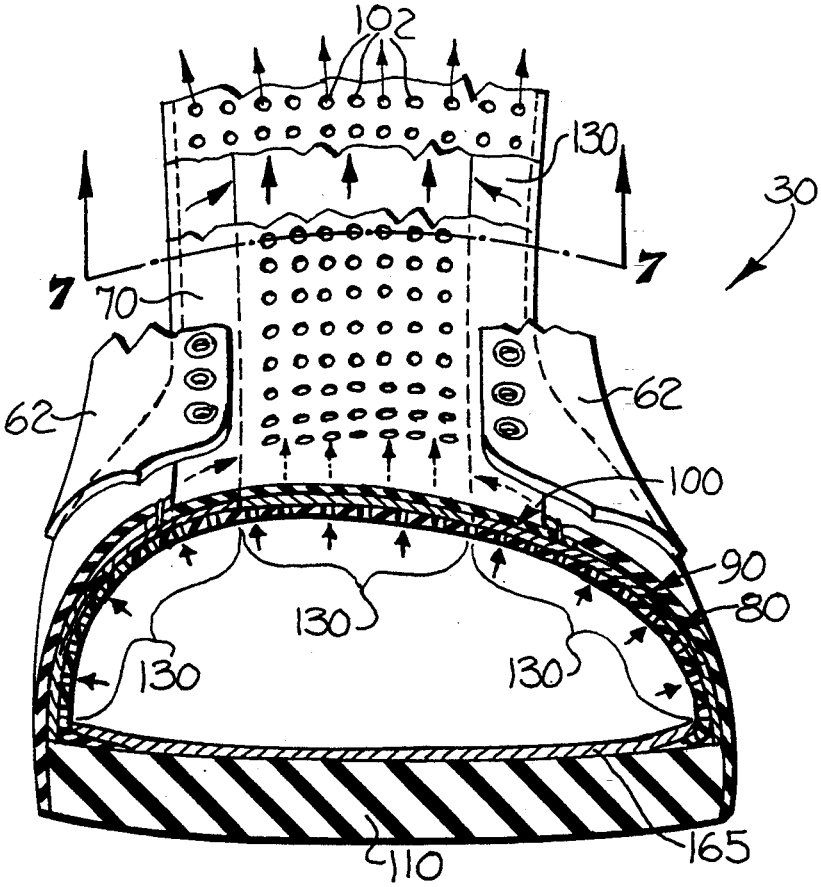
FIG. 5 is a front cross-sectional view of the athletic shoe shown in FIG. 1 taken along line 5—5 with parts broken away for clarity.

Referring to FIGS. 4 and 5, an intermediate fabric layer 90 is in contacting engagement with the inner hydrophilic fabric layer 80. In the illustrated embodiment, the intermediate fabric layer 90 includes a medial portion formed of a hydrophobic fabric layer 94 and opposite side portions formed of hydrophilic fabric layers 92. The hydrophobic fabric layer medial portion 94 is preferably a woven acrylic material. However, other hydrophobic fabrics well known to those skilled in the art, such as polyproplene or polyester, may also be used. The hydrophilic fabric opposite side portions 92 of the intermediate fabric layer 90 further absorb the perspiration 130 from and passing through the inner hydrophilic fabric layer 80 as shown in FIG. 7.

Figure 6:
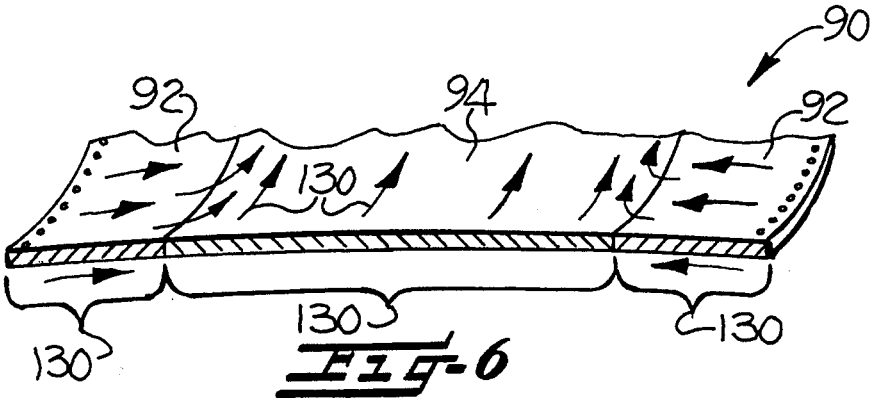
FIG. 6 is a fragmentary perspective view of the intermediate fabric layer of the tongue portion of the athletic shoe shown in FIG. 4 taken along line 6—6.

The hydrophobic fabric layer medial portion 94 preferably extends lengthwise across the hydrophilic fabric top create the opposite side portions 92 therein, but other constructions well known to those skilled in the art may also be used. The hydrophobic fabric layer medial portion 94 of the intermediate fabric layer 90 wicks the perspiration 130 from the inner hydrophilic fabric layer 80 and the hydrophilic fabric opposite side portions 92 of the intermediate fabric layer 90 as shown in FIG. 6.

Figure 7:
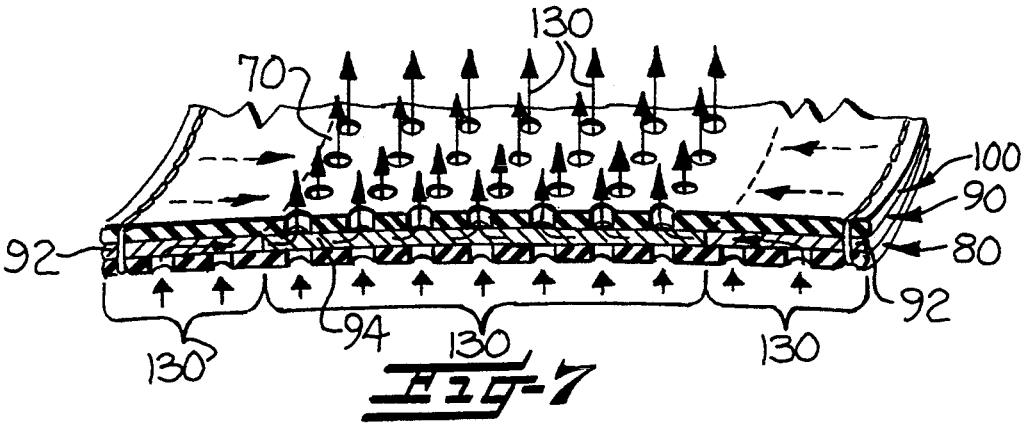
FIG. 7 is a fragmentary perspective view of the tongue portion of the athletic shoe shown in FIG. 5 taken along line 7—7.
Figure 8:
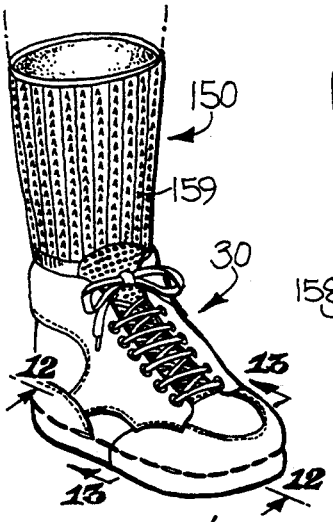
FIG. 8 is a perspective view of the footwear according to the present invention showing a moisture management knitted sock in combination with the athletic shoe shown in FIG. 1.
Figure 9:
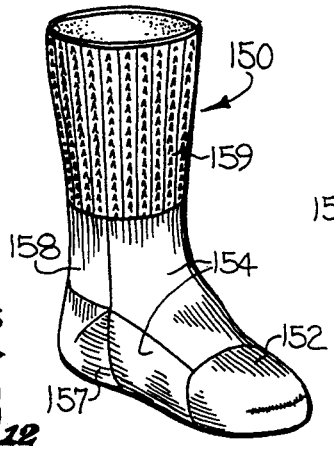
FIG. 9 is a perspective view of the moisture management knitted sock without the shoe as shown in FIG. 8.

Perspiration 130 is then transferred to the overlying outer fabric layer 100 as shown in FIGS. 4, 5, and 7. The overlying outer fabric layer 100 is constructed of a fabric containing hydrophilic fibers and is in contacting engagement with the intermediate fabric layer 90. Perspiration 130 is transferred to the overlying outer hydrophilic fabric layer 100 for evaporation into the surrounding atmosphere and aided thereby with perforations 102 therein. The overlying outer hydrophilic fabric layer, like the inner hydrophilic fabric layer of the tongue portion is also not restricted to any one fiber type and may also be leather or nylon.

The shoe 30 according to the present invention is also conceived, for economy and other purposes, to apply to embodiments having the hydrophobic fabric layer medial portion 94 and hydrophilic fabric opposite side portions 92 forming an underlying fabric layer, no inner hydrophilic fabric layer would be needed, and the aforementioned overlying outer hydrophilic fabric layer 100 would still be the outer fabric layer of the tongue portion 70 of the shoe 30.

Additionally, the inner 80, intermediate 90, and outer 100 fabric layers of the tongue portion 70 of the shoe 30 may also extend into the toe portion 40 of the shoe 30 for similar functional purposes. The toe portions 83, 93 of the inner fabric layer and intermediate fabric layer are shown in FIG. 4. The inner hydrophilic fabric layer 80 and the hydrophilic opposite side portions 92 of the intermediate fabric layer 90 may also extend into the lower arch portion 65 of the instep portion 60 of the shoe 30 to thereby form side wing portions 81, 91 respectively as seen FIG. 4 and the parts broken away in FIG. 1. The side wing portions 81 of the inner hydrophilic fabric layer 80 are adapted to overlie the lower arch portion of the instep portion of the wearer's foot to thereby absorb the perspiration 130 therefrom. In turn, the hydrophilic fabric side wing portions 91 of the intermediate fabric layer 90 overlie and are in contacting engagement with the hydrophilic fabric side wing portions 81 of the inner hydrophilic fabric layer 80 to thereby further absorb the perspiration 130 therefrom. The perspiration 130 in the hydrophilic fabric side wing portions 91 of the intermediate fabric layer 90 is also wicked by the hydrophobic fabric layer medial portion 94 for transferring to the overlying outer hydrophilic fabric layer 100 as described above.

The combination of the shoe 30 as shown in FIG. 1 and the moisture management knit sock 150 according to U.S. Pat. No. 4,828,007 by the same inventor, and hereby incorporated herein by reference, is shown in FIGS. 8–13.

Figure 10:
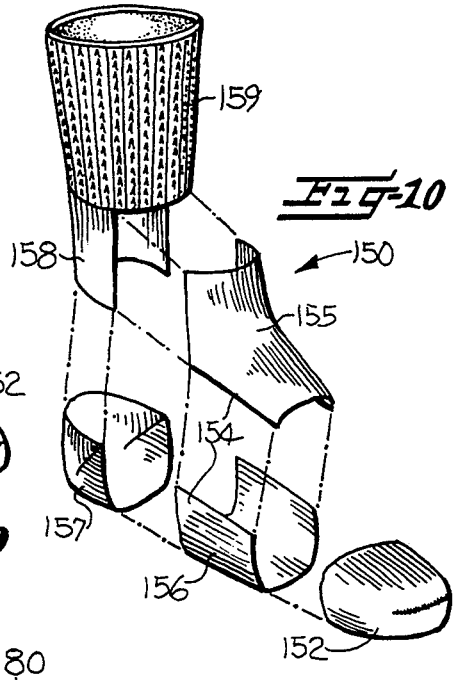
FIG. 10 is an exploded perspective view of the moisture management knitted sock of FIG. 9.
Figure 11:
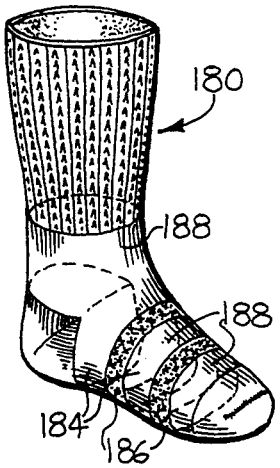
FIG. 11 is a perspective view of another embodiment of the moisture management knitted sock with a banded instep portion.

An exploded perspective view of the knitted sock 150 is shown in FIG. 10 illustrating the various portions of the knitted sock 150: the toe portion 152, instep portion 154, heel portion 157, ankle portion 158 and sock upper portion 159. The toe portion 152 is formed from hydrophilic knit fabric. The instep portion 154 has an upper 155 and lower 156 section both formed of hydrophobic knit fabric in this embodiment. Also shown in FIG. 10 are a knit heel portion 157 formed of hydrophilic knit fabric and a knit ankle portion 158 formed of hydrophobic knit fabric. The sock upper portion 159 is tubular and cushioned to fit about the wearer's leg and may be formed of various knit fabrics well known to those skilled in the art. FIG. 11 shows another embodiment of the knitted sock 180 having a knit instep portion 184 with bands 186 of hydrophilic knit fabric adjacent hydrophobic knit fabric 188.

Figure 13:
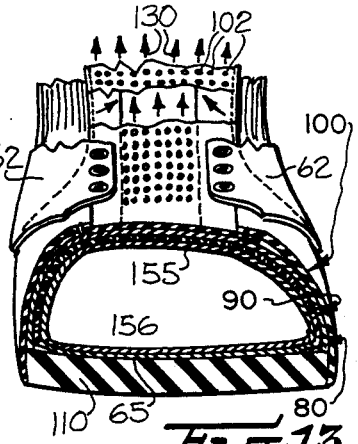
FIG. 13 is a transverse vertical cross-sectional view of the footwear according to the present invention taken along line 13—13 of FIG. 8 with parts broken away for clarity.
Figure 12:
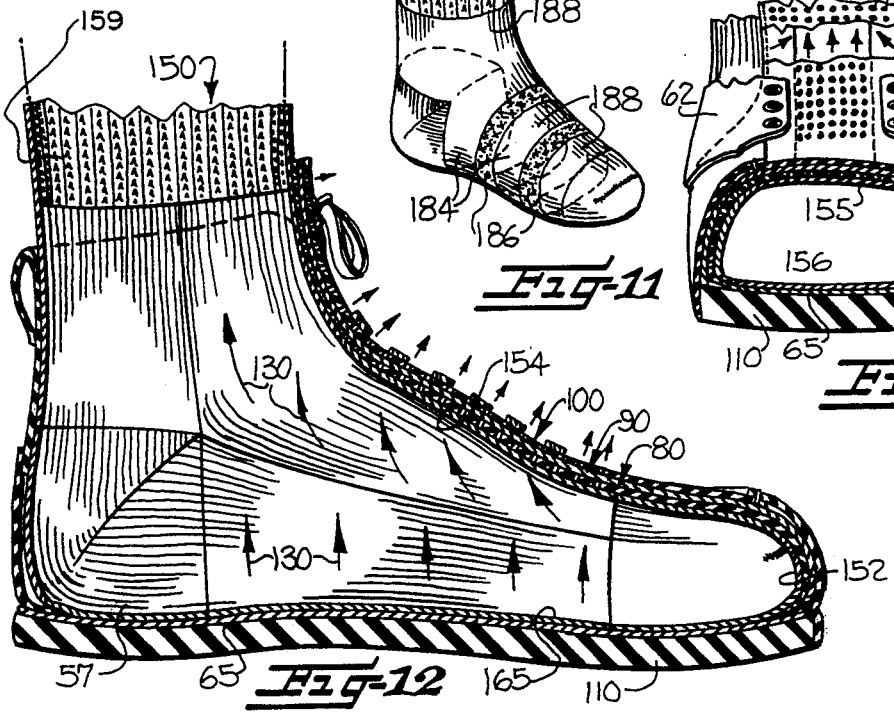
FIG. 12 is a longitudinal vertical cross-sectional view of the footwear according to the present invention taken along line 12—12 of FIG. 8.

FIGS. 12 and 13 illustrate the removal and dissipation of the perspiration 130 from the wearer's foot. In these views, perspiration 130 accumulating in the toe portion of the foot is absorbed by the hydrophilic knit fabric of the toe portion 152 of the knitted sock 150. The perspiration 130 is then wicked from the hydrophilic knit toe portion 152 to the hydrophobic knit instep portion 154 of the knitted sock 150 for transferring to the overlying and contacting tongue portion 70 of the shoe 30. The hydrophilic knit heel portion 157 of the knitted sock 150 also absorbs perspiration 130 which is then also wicked to the hydrophobic knit instep portion 154 of the knitted sock 150 for transferring to the tongue portion 70 of the shoe 30.

In the knitted sock embodiment of FIG. 11, the perspiration 130 is also absorbed by the medial bands 186 of hydrophilic knit fabric in the instep portion 184 of the knitted sock 180. The adjacent hydrophobic knit fabric 188 of the knitted sock 180 then wicks the perspiration 130 from the hydrophilic knit medial bands 186 and the hydrophilic knit toe portion for transferring to the tongue portion 70 of the shoe 30 similar to the embodiment of FIGS. 9 and 10.

The inner hydrophilic fabric layer 80 of the athletic shoe 30 is overlying and is in contacting engagement with the upper section 155 of the hydrophobic knit instep portion 154 of the knitted sock 150. Perspiration 130 in the upper section 155 of the hydrophobic knit instep portion 154 of the knitted sock 150 is then transferred to the overlying and contacting inner hydrophilic fabric layer 80 of the tongue portion 70 of the athletic shoe 30. In addition, the toe portion 83 and the side wing portions 81 of the inner hydrophilic fabric layer 80 of the shoe 30 also absorb perspiration 130 from the knit instep portion 154 and knit toe portion 152 of the knitted sock 150.

The perspiration 130 is further transferred to the hydrophilic fabric opposite side portions 92, toe portions 93 and side wing portions 91, of the intermediate fabric layer 90 of the shoe 30 through absorption from the inner hydrophilic fabric layer 80. The perspiration 130 is then wicked from the hydrophilic fabric layers 92 of the intermediate fabric layer 90 to the hydrophobic fabric layer medial portion 94. In turn, the overlying and contacting outer hydrophilic fabric layer 100 absorbs the wicked perspiration 130 from the hydrophobic fabric layer medial portion 94 of the intermediate fabric layer 90 for evaporation to the surrounding atmosphere and thereby removing and dissipating the perspiration 130 from the wearer's foot.

Figure 14:
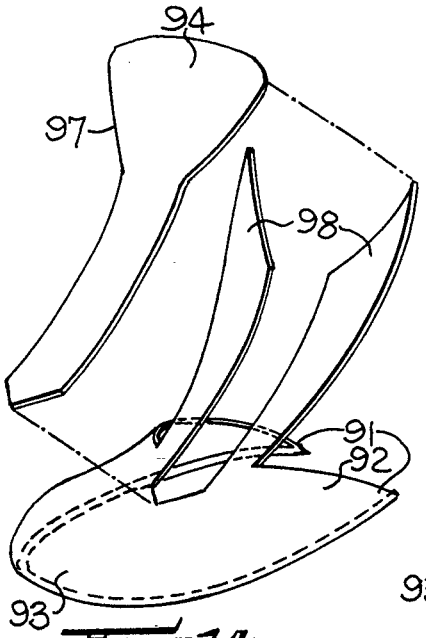
FIG. 14 is an exploded perspective view of the intermediate fabric layer of the tongue portion of the shoe showing the hydrophobic fabric layer medial portion and the hydrophilic fabric opposite side portions of the intermediate fabric layer according to the present invention.
Figure 15:
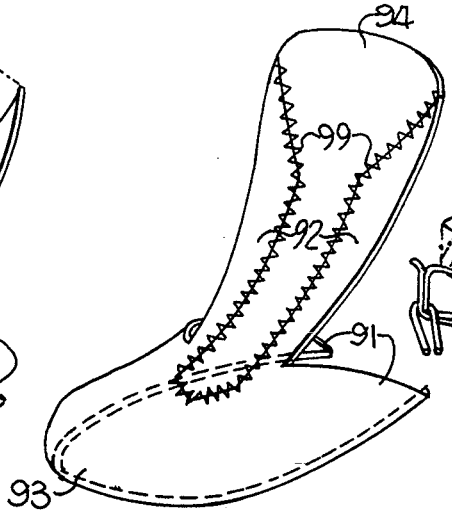
FIG. 15 is another perspective view of the intermediate fabric layer of the tongue portion of the shoe showing the hydrophobic fabric layer medial portion and hydrophilic fabric opposite side portions stitched together with cross-stitching.

The construction of the intermediate fabric layer 90 of the tongue portion 70 of the shoe 30 is best understood by reference to FIGS. 14–23. FIGS. 14 and 15 illustrate the hydrophobic fabric layer medial portion 94 and the hydrophilic fabric opposite side portions 92 secured to the lengthwise extending edges of the hydrophobic fabric layer medial portion 94. The hydrophobic fabric layer medial portion 94 and the hydrophilic fabric opposite side portions 92 are both preferably die cut from the respective fabrics. The hydrophobic fabric layer medial portion 94 has an upper 97 and lower end 98 as do each of the hydrophilic fabric opposite side portions 92. The hydrophobic fabric layer medial portion 94 is preferably shaped to diverge at the upper end 97 for increasing the surface area of the hydrophobic fabric. In turn, the hydrophilic fabric opposite side portions 92 preferably converge and terminate at the upper end 97 to permit the enlarging of the hydrophobic fabric layer medial portion 94 at the upper end 97 thereof. The lower end 98 of the hydrophobic fabric layer medial portion 94 preferably converges to decrease the surface area of the hydrophobic fabric layer 94 of the intermediate fabric layer 90. The lower end 98 of the hydrophilic fabric opposite side portions 92 diverge and join to increase the surface area of the hydrophilic fabric layer 92 of the intermediate fabric layer 90.

Figure 16:
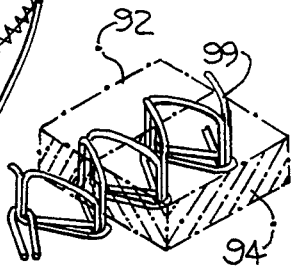
FIG. 16 is an enlarged view of the cross-stitching as shown in FIG. 15.
Figure 17:
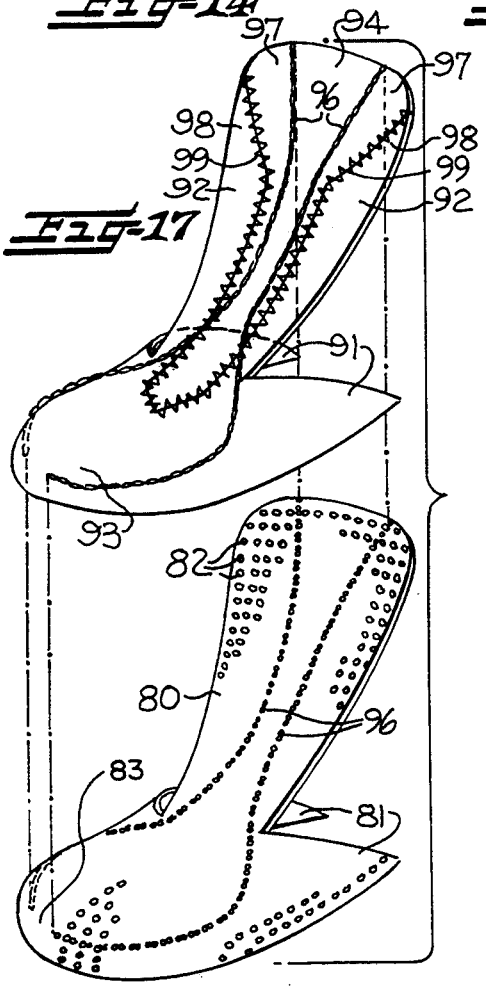
FIG. 17 is an exploded view of the intermediate fabric layer and the inner hydrophilic fabric layer of the tongue portion of the shoe with wick stitching extending from the hydrophobic fabric layer medial portion and into the hydrophilic fabric side portions of the intermediate fabric layer, and wick stitching also extending from the internal intermediate fabric layer into the inner hydrophilic fabric layer.
Figure 18:
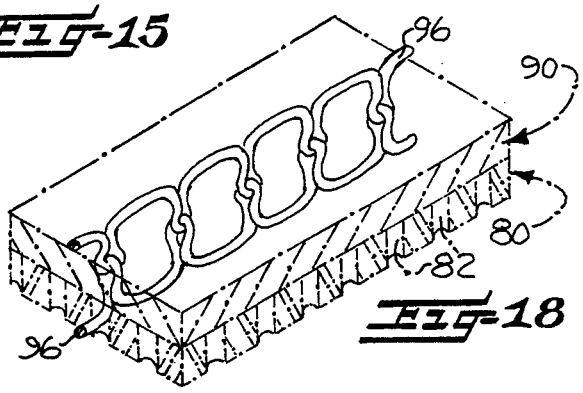
FIG. 18 is an enlarged fragmentary view of the wick stitching as shown in FIG. 17.
Figure 19:
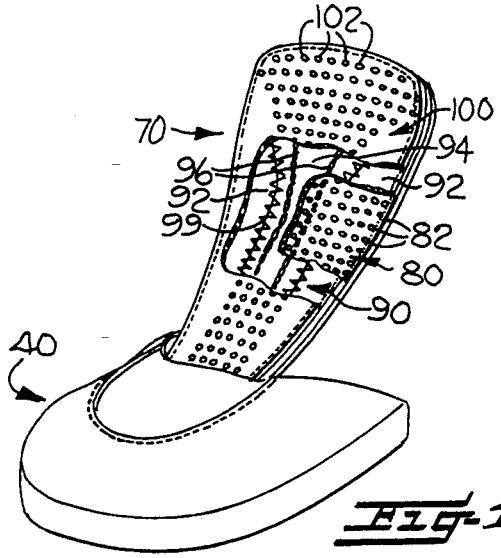
FIG. 19 is a perspective view of the tongue portion of the shoe showing the cross-stitching and wick stitching according to the present invention with parts broken away for clarity.

The hydrophobic fabric layer medial portion 94 is preferably formed of a woven acrylic material such as Duraspun. But other hydrophobic materials may be used, such as polyproplene or polyester and they may be formed of a knit, woven, non-woven or felted fibers. The hydrophilic fabric opposite side portions 92 are preferably formed of a knit, woven, non-woven, or felted fibers. The two fabric layers 92, 94 are also preferably cross-stitched together by a hydrophobic multi-filament textile thread, but other methods well known to those skilled in the art may also be used to keep the two fabric layers 92, 94 together or to form a single fabric layer 90. FIG. 16 best illustrates the cross-stitching 99 used in the intermediate fabric layer 90 (FIG. 15) to join the hydrophobic fabric layer medial portion 94 and the hydrophilic fabric opposite side portions 92.

FIGS. 14 and 15 illustrate an alternative embodiment of the invention comprising a hydrophobic fabric layer medial portion 94 that has hydrophilic fabric opposite side portions 92. When the opposite side portions 92 are secured to the lengthwise extending edges of the hydrophobic fabric layer medial portion 94, they form a single fabric layer, shown in FIG. 15. This structure can be inserted into footwear, by itself, independent of inner hydrophilic fabric layer 80 or overlying outer hydrophilic fabric layer 100. Perspiration 130 from a wearer's foot will be absorbed by toe portion 93, hydrophilic fabric opposite side portions 92 and side wing portions 91. Perspiration 130 so absorbed is then wicked from the hydrophilic fabric opposite side portions 92 to the hydrophobic fabric layer medial portion 94 for evaporation to the atmosphere. This embodiment of the invention is useful as a retrofit device for insertion into existing footwear such as a ski boot.

As illustrated in FIG. 15, the hydrophilic fabric opposite side portions 92 can be joined to the hydrophobic fabric layer medial portion 94 by cross-stitching 99 to form a single layer structure. In order to enhance the wicking of perspiration, a wick stitching 96 (FIG. 17) can be added as described below.

Referring to FIGS. 17–23, shown is wick stitching 96 formed of textile thread extending from the hydrophobic fabric layer medial portion 94 and into the hydrophilic fabric opposite side portions 92 of the intermediate fabric layer 90. The wick stitching 96, shown enlarged in FIG. 18, also preferably further extends from the intermediate fabric layer into the inner hydrophilic fabric layer 80. It is also contemplated that the wick stitching, however, may also only extend across the hydrophobic 94 and hydrophilic 92 fabric layers of the intermediate fabric layer 90 to enhance wicking of perspiration between these two intermediate fabric layers. In addition, the combination of two above wick stitching 96 locations may be used. The wick stitching 96 is preferably a hydrophobic multi-filament yarn such as polypropylene to thereby further assist the wicking of perspiration 130 from the hydrophilic fabric opposite side portions 92 in the intermediate fabric layer 90 to the hydrophobic fabric layer medial portion 94. The wick stitching 96 also enhances the wicking of perspiration 130 from the inner hydrophilic fabric layer 80 to the hydrophobic fabric layer medial portion 94 of the intermediate fabric layer 90.

Figure 20:
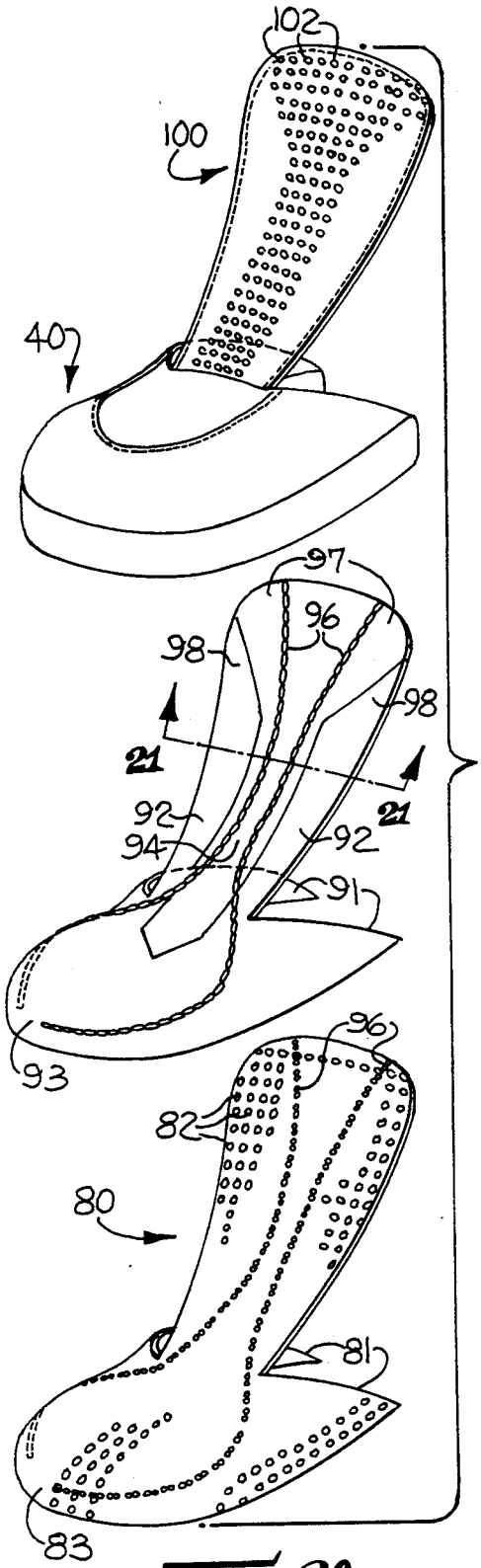
FIG. 20 is an exploded view of the tongue portion of the shoe similar to FIG. 4, but including the wick stitching according to the present invention.
Figure 21:
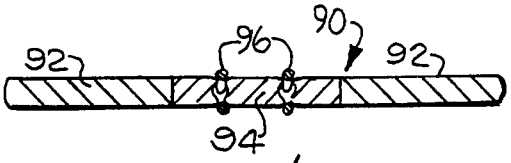
FIG. 21 is a transverse cross-sectional view taken along line 21—21 of FIG. 20.
Figure 22:
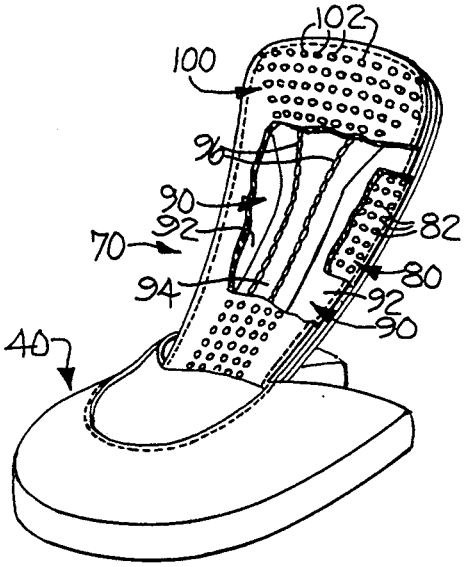
FIG. 22 is another perspective view of the tongue portion of FIG. 20 with parts broken away for clarity.
Figure 23:
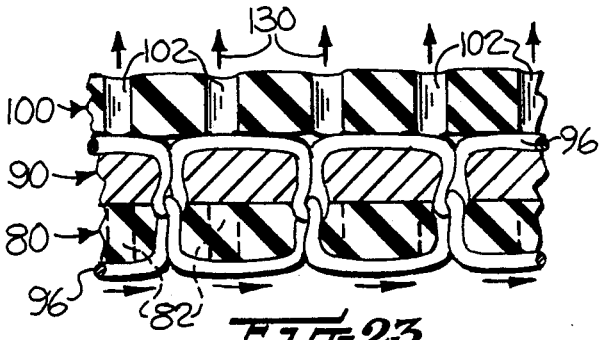
FIG. 23 is an enlarged fragmentary cross-sectional view of the layered construction of the tongue portion of the shoe and showing the wick stitching extending from the intermediate fabric layer and into the inner hydrophilic fabric layer.

As shown in FIG. 21, the wick stitching 96 is located in the hydrophobic fabric layer medial portion 94 of the intermediate fabric layer 90 from the view taken along line 21—21 of FIG. 20. The wick stitching 96 is arranged in sinusoidal or other patterns extending into the various fabric layers of the tongue portion 70 of the shoe 30, again preferably between the inner hydrophilic fabric layer 80 and the intermediate fabric layer 90. An enlarged view of this wick stitching 96 extending into the inner hydrophilic fabric layer 80 for construction purposes is best illustrated in FIG. 23.

In the drawings and specification, there have been disclosed typical preferred embodiments of the invention and, although specific terms are employed, they are used in a generic and descriptive sense only and not for the purpose of limitation, the scope of the invention being set forth in the following claims.

That which is claimed is:

1. A shoe for providing added comfort to the wearer by facilitating the removal and dissipation of perspiration from the foot of the wearer, said shoe comprising a tongue assembly adapted to overlie the instep and toe portion of the wearer's foot, a heel portion, a sole and an instep, the improvement comprising:

a tongue assembly having an outer layer, an intermediate layer, and an inner layer;

said outer layer being constructed of a hydrophilic fabric;

said intermediate layer being constructed of a hydrophilic fabric with a medial portion constructed of a hydrophobic fabric, said intermediate layer being positioned beneath said overlying outer layer and in contacting engagement therewith;

said inner layer being constructed of a hydrophilic fabric, being positioned beneath said intermediate layer and being in contacting engagement therewith; and, said inner layer adapted to overlie and be in contacting engagement with the instep and toe portion of the wearer's foot so that perspiration from the foot of the wearer is absorbed by said inner layer and wicked therefrom by said contacting engagement with the intermediate layer medial portion and thereby transferred to said overlying cuter layer of said tongue assembly of said shoe for evaporation therefrom to the atmosphere.

2. A shoe according to claim 1 further comprising wick stitching formed of textile thread extending from said intermediate fabric layer into inner hydrophilic fabric layer of said tongue portion of said shoe for providing added wicking of perspiration from said inner hydrophilic fabric layer to said intermediate fabric layer.

3. A shoe according to claim 2 wherein said wick stitching forms a sinusoidal pattern along said intermediate fabric layer and said inner hydrophilic fabric layer.

4. A shoe according to claim 1 wherein said inner hydrophilic fabric layer and said intermediate fabric layer of said tongue portion of said shoe extend from said tongue portion and into a toe portion of said shoe and adapted for absorbing perspiration from the toe portion of the wearer's foot so as to in turn be wicked therefrom by said intermediate hydrophobic fabric layer of said tongue portion of said shoe and thereby transferred to said overlying outer hydrophilic fabric layer for evaporation therefrom to atmosphere.

5. A shoe according to claim 4 wherein said intermediate fabric layer and said inner hydrophilic fabric layer toe portions of said shoe extend into an instep portion of said shoe for absorbing and wicking perspiration from the instep portion of said wearer's foot.

6. A shoe according to claim 1 wherein both of said overlying inner and outer hydrophilic fabric layers of said tongue portion of said shoe include a series of perforations for facilitating the transfer of perspiration therethrough.

7. A shoe according to claim 1 wherein both of said overlying inner and outer hydrophilic fabric layers of said tongue portion of said shoe comprise leather for added comfort to the wearer of the shoe.

8. A shoe according to claim 7 wherein said inner leather layer of said tongue portion of said shoe is formed of softer more pliable leather than said overlying outer leather layer of said tongue portion of said shoe for added comfort to the wearer of the shoe.

9. A shoe according to claim 1 wherein said hydrophobic fabric layer of said intermediate fabric layer of said tongue portion comprises a woven acrylic material.

10. A shoe according to claim 1 wherein said hydrophobic fabric layer of said tongue portion of said shoe comprises a woven polyproplene material.

11. In a shoe for facilitating the removal and dissipation of perspiration from the foot of the wearer, a tongue assembly adapted to overlie the instep and toe portion of the wearer's foot, said tongue assembly comprising:.

inner and outer fabric layers constructed of a hydrophilic fabric;

an intermediate fabric layer positioned between said over-lying inner and outer hydrophilic fabric layers and being in contacting engagement therewith;

said intermediate fabric layer comprising a medial portion constructed Of a hydrophobic fabric layer and opposite side portions constructed of hydrophilic fabric layers; and, said inner layer being adapted to overlie and be in contacting engagement with the instep and toe portion of the wearer's foot so that perspiration from the foot of the wearer is absorbed by said inner fabric layer and said opposite side portions of said intermediate fabric layer and wicked therefrom by said fabric layer medial portion of said intermediate fabric layer and thereby transferred to said overlying outer fabric layer of said tongue assembly for evaporation therefrom to the atmosphere.

12. A shoe according to claim 11 further comprising wick stitching formed of textile thread extending from said hydrophobic fabric layer medial portion into said hydrophilic fabric opposite side portions of said intermediate fabric layer for providing added wicking of perspiration.

13. A shoe according to claim 12 wherein said wick stitching further extends into said inner hydrophilic fabric layer of said tongue portion of said shoe for providing wicking from said inner hydrophilic fabric layer to said hydrophobic fabric layer medial portion of said intermediate fabric layer.

14. A shoe according to claim 12 wherein said wick stitching forms a sinusoidal pattern along said hydrophobic fabric layer medial portion and said hydrophilic fabric opposite side portions.

15. A shoe according to claim 11 wherein said hydrophobic fabric layer medial portion of said intermediate fabric layer comprises an upper end and a lower end, said upper end diverging for increasing the surface area of said hydrophobic fabric layer, said lower end converging for decreasing the surface area of said hydrophobic fabric layer.

16. A shoe according to claim 10 wherein said hydrophilic fabric opposite side portions of said intermediate fabric layer comprise upper lower ends, said upper end converging and terminating at said upper end thereof for increasing the surface area of said hydrophobic fabric layer medial portion, said lower end diverging for increasing the surface area of the hydrophilic fabric layer of said intermediate fabric layer.

17. A shoe according to claim 11 further comprising cross-stitching formed of textile thread joining said hydrophobic fabric layer medial portion and said hydrophilic fabric opposite side portions of said intermediate fabric layer.

18. A shoe according to claim 11 wherein said inner hydrophilic fabric layer and said hydrophilic fabric of said intermediate fabric layer of said tongue portion of said shoe extend from said tongue portion and into a toe portion of said shoe and adapted for absorbing perspiration from the toe portion of the wearer's foot so as to in turn be wicked therefrom by said hydrophobic fabric layer medial portion of said intermediate fabric layer of said tongue portion and thereby transferred to said overlying outer hydrophilic fabric layer for evaporation therefrom to atmosphere.

19. A shoe according to claim 18 wherein said intermediate fabric layer and said inner hydrophilic fabric layer toe portions of said shoe extend into an instep portion of said shoe and adapted for absorbing and wicking perspiration from the instep portion of the wearer's foot.

20. A shoe according to claim 11 wherein both of said overlying inner and outer hydrophilic fabric layers of said tongue portion of said shoe include a series of perforations for facilitating the transfer of perspiration therethrough.

21. A shoe according to claim 11 wherein both of said overlying inner and outer hydrophilic fabric layers of said tongue portion of said shoe comprise leather for added comfort to the wearer of said shoe.

22. A shoe according to claim 21 wherein said inner leather layer of said tongue portion of said shoe is formed of softer more pliable leather than said overlying outer leather layer of said tongue portion of said shoe for added comfort to the wearer of said shoe.

23. A shoe according to claim 11 wherein said hydrophobic fabric layer medial portion of said tongue portion of said shoe comprises a woven acrylic material.

24. A shoe according to claim 11 wherein said hydrophobic fabric layer medial portion of said tongue portion of said shoe comprises a woven polyproplene material.

25. In a shoe for facilitating the removal and dissipation of perspiration from the foot of the wearer, a tongue assembly, adapted to overlie the instep and toe portion of the wearer's foot, comprising:

an overlying outer fabric layer and an underlying fabric layer, located beneath said overlying outer fabric layer and being in contacting engagement therewith;

said underlying fabric layer comprising a medial portion constructed of a hydrophobic fabric and opposite side portions constructed of a hydrophilic fabric layer; and, said underlying fabric layer adapted to overlie the instep and toe portion of the wearer's foot so that perspiration from the foot of the wearer is absorbed by said underlying fabric layer opposite side portions and wicked therefrom by said underlying fabric layer medial portion and thereby transferred to said overlying fabric layer for evaporation therefrom to the atmosphere.

26. A shoe according to claim 25 further comprising wick stitching formed of textile thread extending from said hydrophobic fabric layer medial portion in said hydrophilic fabric opposite side portions of said tongue portion of said shoe for providing added wicking of perspiration from said hydrophilic opposite side portions to said hydrophobic fabric layer medial portion.

27. A shoe according to claim 26 wherein said wick stitching forms a sinusoidal pattern extending from said hydrophobic fabric layer medial portion to said hydrophilic fabric opposite side portions.

28. A shoe according to claim 25 wherein said hydrophobic fabric layer medial portion of said underlying fabric layer comprises an upper end and a lower end, said upper end diverging for increasing the surface area of said hydrophobic fabric layer, said lower end converging for decreasing the surface area of said hydrophobic fabric layer.

29. A shoe according to claim 28 wherein said hydrophilic fabric opposite side portions of said underlying fabric layer comprise upper and lower ends, said upper end converging and terminating at said upper end thereof for increasing the surface area of said hydrophobic fabric layer medial portion, said lower end diverging for increasing the surface area of the hydrophilic fabric of said intermediate fabric layer.

30. A shoe according to claim 25 further comprising cross-stitching formed of textile thread joining said hydrophobic fabric layer medial portion and said hydrophilic fabric opposite side portions of said underlying fabric layer.

31. A shoe according to claim 25 wherein said underlying hydrophilic fabric layer of said tongue portion of said shoe extends from said tongue portion and into a toe portion of said shoe and adapted for absorbing perspiration from the toe portion of the foot of the wearer so as to in turn be wicked therefrom by said hydrophobic fabric layer medial portion and thereby transferred to said overlying outer hydrophilic fabric layer of said tongue portion of said shoe for evaporation therefrom to atmosphere.

32. A shoe according to claim 31 wherein said underlying fabric layer of said toe portion of said shoe extends into an instep portion of said shoe for absorbing and wicking perspiration from the instep portion of said wearer's foot.

33. A shoe according to claim 25 wherein said outer hydrophilic fabric layer comprises leather.

34. A shoe according to claim 25 wherein said outer hydrophilic fabric layer includes a series of perforations for facilitating the transfer of perspiration therethrough.

35. A shoe according to claim 25 wherein said hydrophobic fabric layer medial portion of said tongue portion of said shoe comprises a woven acrylic material.

36. A shoe according to claim 25 wherein said hydrophobic fabric layer medial portion of said tongue portion of said shoe comprises a woven polyproplene material.

37. In a shoe for facilitating the removal and dissipation of perspiration from the foot of the wearer, a tongue assembly adapted to overlie the instep and toe portion of the wearer's foot, comprising:

a medial portion constructed of a hydrophobic fabric; and a forward portion and opposite side portions constructed of a hydrophilic fabric;

said tongue assembly adapted to overlie the instep and toe portion of the wearer's foot so that perspiration from the foot of the wearer is absorbed by said hydrophilic forward portion and fabric opposite side portions of said tongue assembly and wicked therefrom by said hydrophobic fabric medial portion and thereby transferred to the atmosphere for evaporation.

38. A tongue assembly according to claim 37 further comprising cross-stitching formed of textile thread joining said hydrophobic fabric medial portion and said hydrophilic fabric opposite side portions.

39. A tongue assembly according to claim 37 wherein said hydrophobic fabric medial portion of said tongue portion of said shoe comprises a woven acrylic material.

40. A tongue assembly according to claim 37 wherein said hydrophobic fabric medial portion of said tongue portion of said shoe comprises a woven polyproplene material.

41. A tongue assembly according to claim 37 further comprising wick stitching formed of textile thread extending from said hydrophobic fabric medial portion to said hydrophilic fabric opposite side portions of said tongue portion of said shoe for providing added wicking of perspiration from said hydrophilic opposite side portions to said hydrophobic fabric medial portion.

42. A tongue assembly according to claim 37 wherein said wick stitching forms a sinusoidal pattern extending from said hydrophobic fabric medial portion to said hydrophilic fabric opposite side portions.

43. A tongue assembly according to claim 37 wherein said hydrophobic fabric medial portion comprises an upper end and a lower end, said upper end diverging for increasing the surface area of said hydrophobic fabric medial portion, and said lower end converging for decreasing the surface area of said hydrophobic fabric medial portion.

44. A tongue assembly according to claim 37 wherein said hydrophilic fabric opposite side portions comprise upper and lower ends, said upper end converging and terminating at the upper end of said hydrophobic medial portion for increasing the surface area thereof, and said lower end diverging for increasing the surface area of the hydrophilic medial portion.

45. A tongue assembly according to claim 37 wherein said forward portion of said tongue assembly extends from said instep portion and is adapted for absorbing perspiration from said toe portion of the foot of the wearer so that the perspiration is wicked therefrom by said medial portion for evaporation therefrom to the atmosphere.

46. A tongue assembly according to claim 37 wherein said hydrophilic fabric forward portion of said tongue assembly extends into said instep portion of said shoe for absorbing and wicking perspiration from the sides of a wearer's foot.

* * * * *

UNITED STATES PATENT AND TRADEMARK OFFICE

CERTIFICATE OF CORRECTION

PATENT NO. : 5,365,677

DATED : November 22, 1994

INVENTOR(S) : Raymond E. Dahlgren

It is certified that error appears in the above-indentified patent and that said Letters Patent is hereby corrected as shown below:

Title page, item [76], inventor: should read--Raymond E. Dahlgren--.

Signed and Sealed this

Twenty-fourth Day of January, 1995

*Attest:*

Bruce Lehman

BRUCE LEHMAN

*Attesting Officer*

*Commissioner of Patents and Trademarks*